US009726028B2

(12) United States Patent
Marra et al.

(10) Patent No.: US 9,726,028 B2
(45) Date of Patent: Aug. 8, 2017

(54) DUCTILE ALLOYS FOR SEALING MODULAR COMPONENT INTERFACES

(75) Inventors: John J. Marra, Winter Springs, FL (US); Brian J. Wessell, Orlando, FL (US); Allister W. James, Chuluota, FL (US); Jan H. Marsh, Orlando, FL (US); Paul J. Gear, Longwood, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 1609 days.

(21) Appl. No.: 13/171,699

(22) Filed: Jun. 29, 2011

(65) Prior Publication Data

US 2013/0004294 A1 Jan. 3, 2013

(51) Int. Cl.

| | |
|---|---|
| ***F01D 9/04*** | (2006.01) |
| ***F01D 11/00*** | (2006.01) |
| ***B22D 19/00*** | (2006.01) |
| ***B22D 19/04*** | (2006.01) |

(52) U.S. Cl.

CPC ..... *F01D 9/042* (2013.01); *B22D 19/0072* (2013.01); *B22D 19/04* (2013.01); *F01D 11/006* (2013.01); *F05D 2300/10* (2013.01); *F05D 2300/506* (2013.01); *F05D 2300/518* (2013.01); *Y10T 29/49323* (2015.01)

(58) Field of Classification Search

CPC ..... F01D 9/042; F01D 11/005; F01D 11/006
USPC ..... 415/134, 137, 173.7, 174.4, 191, 200, 415/209.2, 209.3, 209.4
See application file for complete search history.

(56) References Cited

U.S. PATENT DOCUMENTS

| | | | | |
|---|---|---|---|---|
| 3,610,769 | A | 10/1971 | Schwedland et al. | |
| 3,967,353 | A | 7/1976 | Pagnotta et al. | |
| 4,300,868 | A | 11/1981 | Wilkinson et al. | |
| 4,519,745 | A * | 5/1985 | Rosman et al. | 416/96 A |
| 5,630,700 | A | 5/1997 | Olsen et al. | |
| 5,797,725 | A | 8/1998 | Rhodes | |
| 5,904,201 | A | 5/1999 | Jackson et al. | |
| 6,464,456 | B2 | 10/2002 | Darolia et al. | |
| 7,052,234 | B2 | 5/2006 | Wells et al. | |
| 7,452,189 | B2 | 11/2008 | Shi et al. | |
| 7,993,104 | B1 * | 8/2011 | Ewing, Jr. | 416/226 |
| 2009/0196761 | A1 | 8/2009 | James | |
| 2010/0068063 | A1 | 3/2010 | Berg et al. | |

OTHER PUBLICATIONS

"Short-Term Rheology of a Polycrystalline Nickel-base Superalloy Involving Delayed Elasticity" Published Sep. 2005.*
"Metals—Melting Temperatures" published Dec. 2008.*
"Special Metals; Waspaloy" published Mar. 2006.*
"Atlas of Formability—Waspaloy" published Jul. 1992.*
Allister W. James; U.S. Appl. No. 12/795,002, filed Jun. 7, 2010; entitled "Multi-Component Assembly Casting".

* cited by examiner

*Primary Examiner* — Justin Seabe

(57) ABSTRACT

A vane assembly (10) having: an airfoil (12) and a shroud (14) held together without metallurgical bonding there between; a channel (22) disposed circumferentially about the airfoil (12), between the airfoil (12) and the shroud (14); and a seal (20) disposed in the channel (22), wherein during operation of a turbine engine having the vane assembly (10) the seal (20) has a sufficient ductility such that a force generated on the seal (20) resulting from relative movement of the airfoil (12) and the shroud (14) is sufficient to plastically deform the seal (20).

12 Claims, 2 Drawing Sheets

DUCTILE ALLOYS FOR SEALING MODULAR COMPONENT INTERFACES

STATEMENT REGARDING FEDERALLY SPONSORED DEVELOPMENT

This invention was made with government support under contract DE-FC26-05NT42644 awarded by the Department of Energy. The government has certain rights in the invention.

FIELD OF THE INVENTION

The present invention relates to a seal for a vane assembly used in a turbine engine. More particularly, the invention relates to a metal seal in a highly ductile state disposed between an airfoil and a mechanically interlocked shroud to prevent leakage into a hot gas path.

BACKGROUND OF THE INVENTION

Modular engine assemblies, such as those in a gas turbine engine, permit many advantages over monolithic parts. In the case of a vane assembly, for example, these advantages include the ability to use different materials for airfoil shrouds and airfoils, ease of repair, and ability to use more advanced cooling schemes. More advanced cooling schemes have traditionally been impractical because of the high rate of manufacturing defects. Modular designs reduce manufacturing defects (i.e. increase yield), and thus make the advanced cooling schemes practical. One method for producing modular turbine engine assemblies such as a vane assembly is bi-casting, where one part of the assembly, such as an airfoil, is first cast. A second part of the assembly, such as the shroud, is then cast around the first component at a later time. The solidification process creates only a mechanical joint interface with no metallurgical bonding. A downside of this process is that there may be resultant gaps between the interface of the airfoil and shrouds. The gap may allow cooling air to leak from the cold side of the shroud into the hot gas path. As a result, there is room for improvement in the art.

BRIEF DESCRIPTION OF THE DRAWINGS

The invention is explained in the following description in view of the drawings that show.

DETAILED DESCRIPTION OF THE INVENTION

Figure 1:
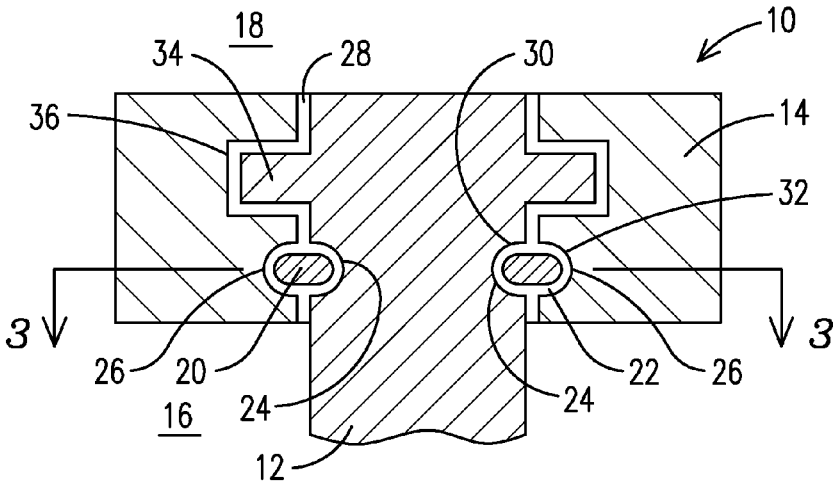
FIG. 1 is a schematic representation of an end of a vane assembly.

The present inventors have devised an innovative seal and method for creating the seal in a modular assembly of a turbine engine. In an embodiment the assembly is a vane assembly, and the seal is disposed at an interface of the airfoil and shroud of the vane assembly and prevents fluid communication across the seal and into the hot gas path. As used herein a shroud refers to either an inner shroud or an outer shroud of a vane assembly comprising at least an inner shroud, one airfoil, and an outer shroud. This fluid communication may be leakage of compressed air from a region exterior to the vane assembly (the cold side) into the hot gas path. As used herein an interface includes regions where surfaces of the airfoil contact the shroud, and any channel intended to hold a seal to prevent leakage. The channel may be disposed between regions of contacting surfaces of the airfoil and shroud and may be formed in the airfoil alone, in the shroud alone, or may be defined by features in both the airfoil and the shroud. For example, the channel may be formed by a lone groove in the airfoil and an associated and unaltered surface of the shroud, or a lone groove in the shroud and an associated and unaltered surface of the airfoil. In an embodiment the channel may be formed by a groove in the airfoil and an associated groove in the shroud.

The seal and method disclosed herein applies to vane assemblies that are composed of discrete airfoils and shrouds that are joined together mechanically, without any metallurgical bonds there between. In an embodiment, the vane assembly may be formed during a bi-casting operation such that the shroud is cast around the airfoil. In such a case the shroud may be a monolithic piece. The airfoil may also be a monolithic piece, however need not be. In such an embodiment mechanical interference of portions of the airfoil and of the shroud with each other prevent the airfoil and shroud from separating from each other. The shroud may be joined to the airfoil mechanically using fasteners, or a combination of mechanical interference and fasteners. Mechanical bonds may not themselves sufficient to prevent fluid from flowing through the interface however, and as a result there may be fluid communication along the interface in the form of leakage into the hot gas path when vane assemblies of this type are used. Until now leakage and its associated and unwanted effects have been tolerated, but the seal and method disclosed here reduces or eliminates this unwanted leakage.

Eliminating unwanted leakage may result in several benefits. Cooling leakage is a significant concern with industrial gas turbines, so reducing cooling leakage will result in a direct improvement in engine performance. Cooling leakage associated with mechanically interlocked assemblies has proved to be a hindrance to advancing their use, and thus their benefits have not been fully realized. With the leakage reduced or eliminated, mechanically interlocked assemblies may be further explored and the benefits more fully realized. Significant effort has gone into manufacturing individual components of assemblies to close tolerance to minimize leakage. Since the seal will be minimizing or eliminating leakage, and since tolerances may be loosened without adversely affecting the seal's performance, the individual components may be made to looser tolerances, and therefore be less expensive to manufacture.

The seal itself is, contrary to the prior art, not intended to carry any mechanical load or properly space or position the components. In other words, the vane assembly is entirely structurally sufficient by itself, without the seal being present in the channel. The vane assembly does not need any contribution from the seal to maintain sufficient strength or a relative position of the airfoil and shroud. As a result, the seal transfers little or no load between components of the assembly. Structural loads transferred from the airfoil to the shroud or vice versa would be transferred through the mechanical interfacing surfaces of the airfoil and vane. It is understood that the seal itself may absorb some force via friction or to accomplish plastic deformation, but this force is negligible and unnecessary to keep the assembly structurally sound. This permits greater design flexibility.

Since the seal is not needed for structural integrity the seal material may be chosen such that the seal material need not retain a specific shape during operation of the turbine engine. In other words, the seal must maintain sufficient structural integrity to prevent leakage there through, but it need not maintain any specific overall shape or cross sectional shape. The seal will be confined by the channel in which it is disposed because it has sufficient cohesion to keep it from leaking out of the channel, but will be ductile enough to change shape as necessary to maintain the sealing function. The seal may be any material that accomplishes this. The seal may be of a monolithic construction, or non monolithic. For monolithic seals, example materials include ductile metals, or any other material such as a high temperature epoxy etc. For non monolithic seals, the seal may be a rope seal or similar that is free to change shape.

When a metal material is selected for a monolithic seal, the metal material is chosen such that it is sufficiently ductile when the turbine engine is operating, similar to embodiments using non-metal seal material. Sufficiently ductile means that a force exerted on the seal by surfaces of the channel in contact with the seal will be sufficient to plastically deform the seal when the channel changes shape. The channel may change shape when the surface on the airfoil and the surface on the shroud that together define the channel move with respect to each other. The forces on the seal resulting from the relative movement include: compressive, when the surfaces move toward each other; shear, when the surfaces move laterally with respect to each other; and tensile, when the surfaces move away from each other and adhesion between a portion of a surface of the seal and a portion of the surfaces defining the channel "stretch" the seal. Such stretching is acceptable so long as the stretching is limited to prevent or minimize tearing out of small bits of material from the parent material.

During operation the metal seal will start out acting as a seal in the interface, preventing leakage through the interface by contacting a channel defining surface on the airfoil and a channel defining surface on the shroud, and spanning between the two. During operation the airfoil and shroud may move with respect to each other, and that movement may change a shape of the channel. If the movement tends to separate the surface on the airfoil that partly defines the channel from the surface on the shroud that partly defines the channel, then the channel (in that location) would become larger than the seal in that dimension if the seal did not also deform. For example, a channel with a circular cross section may become a channel with an oval cross section as the airfoil and the shroud separate from each other. As in the prior art, if the seal disposed therein does not change shape, an opening would form between the seal and at least one surface of the channel, and fluid would leak past the seal, between the seal and the surface of the channel that pulled from the seal. However, the seal disclosed herein is sufficiently ductile that it will adjust and thereby prevent any leakage.

This adjustment, or reshaping, is understood to be driven by forces generated by the channel surfaces acting on the seal surface. In the case of compression, the seal may simply fill any unfilled or newly created volume in the channel and/or operate under higher pressure. In the case of shear the seal may simply reshape to match the shape of the channel. In the case of tension the seal may simply stretch. When surfaces that define the channel move toward each other in one region of the channel there may be another region of the channel where the surfaces that define the other region of the channel move apart from each other. For example, if the airfoil moves in response to combustion fluids it may be "pushed" on the pressure side and "pulled" on the suction side resulting in the airfoil moving in a direction of the suction side with respect to the shroud. In such a case a region of the channel on the suction side may decrease in volume as the surfaces on the airfoil and the shroud that define the channel move closer to each other. Another region of the channel on the pressure side may increase in volume as the surfaces on the airfoil and the shroud that define the other region of the channel move away from each other. As a result, material in a region of the channel with a decreasing volume may move to a region of the channel with an increasing volume. In other words, the seal material may extrude within the channel so that the seal plastically deforms to accommodate changes in the shape of the channel. At any given time one, all, or any combination of these forces may be acting on the seal and the seal may be adjusting to any and/or any combination of these forces simultaneously.

Selecting a seal material that will have sufficient ductility may include an analysis of the melting temperature of the seal material and a comparison of that with the operating temperatures to which the seal will be exposed. Combustion gasses in a gas turbine engine, for example, may be approximately 1500° C., while cold side air may be about 400° C. Since the seal is disposed between the two, it is anticipated that in an embodiment the seal will be exposed to an operating temperature of approximately 500° C.±100° C. Consequently, in the case of a metal seal material, a metal material with a melting temperature slightly above the seal operating temperature may be sufficiently ductile yet sufficiently cohesive. Since a metal seal material would almost always possess the requisite cohesion in a solid state, a measure of the ductility may be used in the selection process. In general, an appropriate seal material would have a Young's modulus that is significantly lower than that of the airfoil and shroud when the vane assembly is at operating temperatures. In an embodiment a material with a Young's modulus of not more than approximately 220 GPa (20 million psi) at 800° C. would possess the requisite ductility at the seal operating temperature of 500° C.±100° C. such that the relative movement of the airfoil and shroud would produce elastic and plastic deformation of the seal material. An example of such a material is pure nickel.

Since seal material may plastically deform in order to prevent a leakage path (or reseal a leakage path), and since this may occur repeatedly over the life of the seal, a seal material with a high creep rate may also be used. Once deformed, internal stresses in a material increase, and if they remain then the material may be resistant to subsequent deformations because the subsequent deforming force may have to first overcome the internal stress before the seal would deform again. A material with a high creep rate will experience a relatively quick reduction in internal stress after an initial deformation, and as a result once a subsequent deformation is called for, the seal material's internal stress will be relatively low, making be "ready" for a subsequent deformation. This is true for both elastic and plastic deformation.

As a material's temperature increases so does its creep rate. In general, an appropriate seal material would have a creep rate that is significantly lower than that of the airfoil and shroud when the vane assembly is at operating temperatures. Acceptable creep rates for such a seal may often occur when the material is at temperatures over half its melting temperature on a Celsius scale. For example, in an embodiment an acceptable seal material for a seal that will be exposed to an operating temperature of 500° C.±100° C. might have a melting temperature of not more than 800° C. to 1200° C., or about 1000° C. In an embodiment a material with a minimum creep rate of approximately 0.001 $s^{-1}$ at a temperature of 800° C. with an applied stress of 500 MPa would possess the requisite creep at the seal operating temperature of 500° C.±100° C. An example of such a material is pure nickel. In an embodiment, when considering a need for sufficient ductility and a desire for a high creep number, a seal material may have a melting temperature from slightly above the operating temperature to which it will be exposed to twice that operating temperature. Although a seal using the materials as described herein may crack upon cooling, this is of little or no consequence because it is not a structural component, because the engine will be off when these cracks are present, and because the cracks will close once the seal is again heated during subsequent operation.

Additionally, suitable seal material must be non reactive with the surfaces of the airfoil and shroud that it will contact. When the seal is installed subsequent to the airfoil and shroud being assembled the seal must also be of a type that can be installed subsequent to the assembly as discussed below. Suitable materials for monolithic seals used in nickel or cobalt based superalloy assembly may include aluminum, aluminum alloys, tin, tin alloys, brass, bronze, pure nickel, and high temperature epoxies etc. A suitable material for non monolithic seals may include those for monolithic seals, and others, in rope form or equivalent.

Turning to the drawings, FIG. 1 is a schematic of a vane assembly 10 made of an airfoil 12 and a shroud 14. The airfoil 12 is within a hot gas path 16, and the hot gas path 16 is separated from a relatively cold region 18 outside the hot gas path 16 by the shroud 14. In an embodiment a seal 20 is disposed in a channel 22 defined in part by a first groove 24 in the airfoil 12 and partly in a second groove 26 in the shroud 14. As used herein, a groove may have any shape, including the semi-circular shape depicted in the figures. The seal 20 is also disposed in an interface 28 between contacting surfaces of the airfoil 12 and the shroud 14. The interface 28 extends from the relatively cold region 18 to the hot gas path 16, and it is along the interface 28 that fluid may travel from the relatively cold region 18 to the hot gas path 16 as leakage. The airfoil 12 and shroud 14 are held in place with respect to each other by contacting surfaces of an airfoil feature 34 and an associated shroud feature 36. In the embodiment shown, seal 20 is disposed between the hot gas path 16 and the feature 34.

Figure 2:
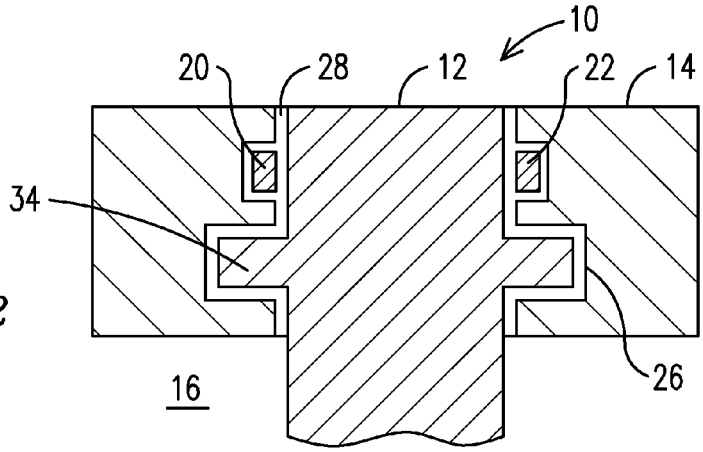
FIG. 2 is a schematic of a different embodiment of the vane assembly of FIG. 1.

In operation the seal 20 presses against a surface 30 of the first groove and a surface 32 of the second groove to perform a sealing function that blocks leakage through the assembly 10 along the interface 28. Seal 20 is also composed of a material that is specifically chosen to be sufficiently ductile in accord with the disclosure herein. FIG. 2 depicts an alternate embodiment of the assembly 10 where the seal 20 is disposed in a channel 22 formed solely of a second groove 26 in the shroud. Alternately, channel 22 could be formed solely of a first groove 24 in the airfoil. In an embodiment with only one groove forming channel 22, a portion of the surface of the opposing component would define part of the channel 22. For example, if the assembly 10 comprises only a first groove 24, then the channel is defined by the first groove 24 and a portion of the surface of the shroud 14. In another embodiment where the assembly 10 comprises only a second groove 26, then the second groove 26 and a respective portion of the surface of the airfoil 12 define the channel 22. FIG. 2 discloses an embodiment where feature 34 is alternately disposed between seal 20 and hot gas path 16.

Figure 3:
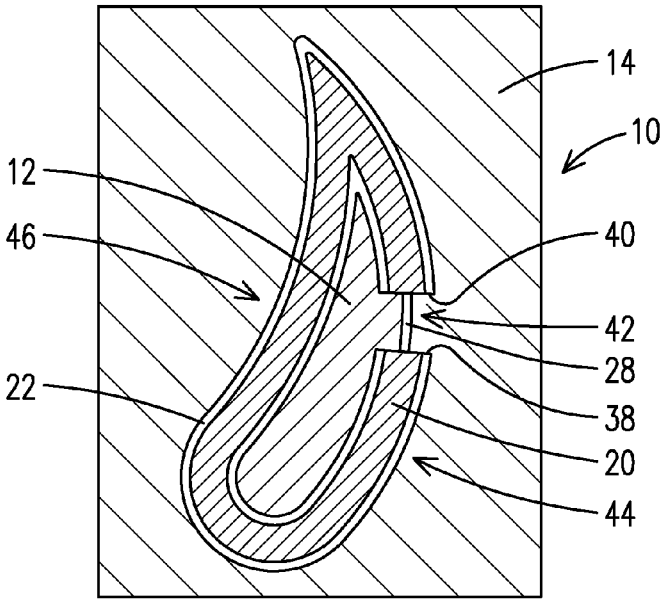
FIG. 3 depicts a cross section taken along line A-A of FIG. 1

FIG. 3 depicts a cross section taken along line A-A of FIG. 1 In an embodiment channel 22 does not extend around an entire perimeter of airfoil 12, but instead has a first end 38 and a second end 40, between which is an unsealed portion 42 of interface 28. As discussed below the unsealed portion 42 may exist in order to aid placement of the seal 20 during manufacture of the assembly 10. The unsealed portion 42 may be disposed at any point around the perimeter of the airfoil 12. In an embodiment the unsealed portion may be disposed on a suction side 44 of the airfoil 12 because it is understood that leakage rates are lower on the suction side 44 than on a pressure side 46. However, other locations may be chosen after an analysis of all design factors, including mechanical and thermal stresses. The unsealed portion 42 may also be minimized in size to minimize leakage associated with the unsealed portion 42.

Figure 4:
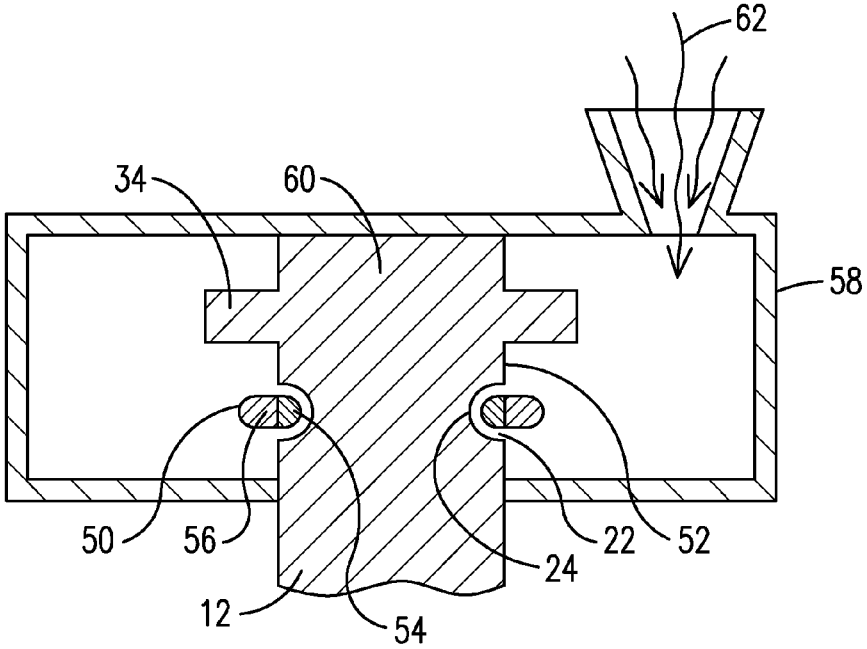
FIG. 4 is a schematic depicting the method of bi-casting a shroud around an airfoil.
Figure 5:
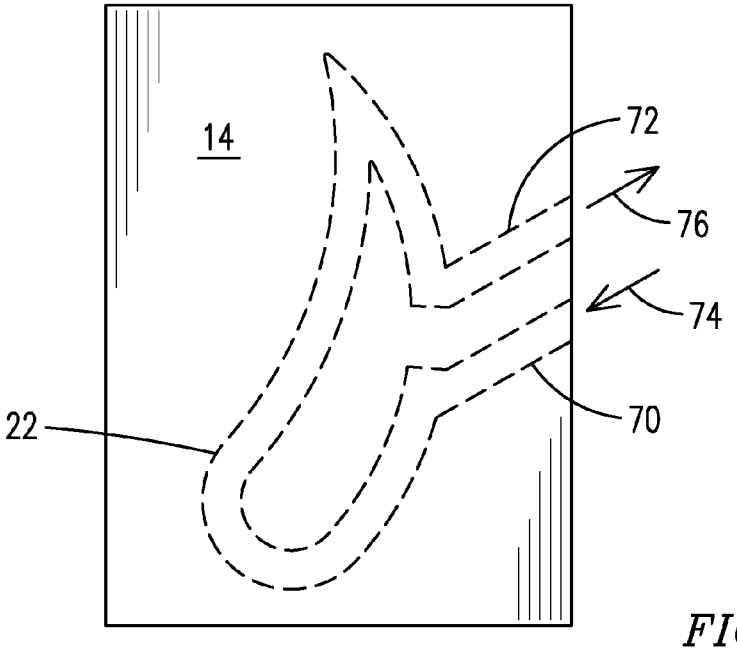
FIG. 5 is a schematic depicting the method of adding the seal.

FIGS. 4 and 5 are used to explain a method of manufacture of the assembly 10. The airfoil 12 may fabricated using any method suitable and know to those in the art. The airfoil 12 may include a first groove 24 that is also fabricated using conventional methods. The first groove 24 is shown to have a semi-circular shape, but any shape that enables a channel is acceptable, such as a triangular or square cross sectional profile etc. The airfoil 12 may alternately have no first groove 24. In an embodiment with a first groove 24 but no second groove 26, a fugitive material disposed in the first groove 24 may simply prevent material from entering the first groove 24 during the subsequent bi-casting operation. In such an embodiment the channel 22 would be defined by the first groove 24 and a respective part of the surface of the shroud 14 to be formed. In an embodiment with a second groove 26, a second groove fugitive material 50 may be used to form the second groove 26. If there is no first groove 24, then the second groove fugitive material 50 may simply be placed against the surface of the airfoil 12 where the second groove 26 is to be formed. In such an embodiment the channel 22 would be defined by the second groove 26 and a respective part of the surface of the airfoil 12.

In an embodiment with a first groove 24 and a second groove 26 a second groove fugitive material 50 may be disposed where the second groove 26 is to be formed. The second groove fugitive material 50 may have any cross sectional shape, such as circular or oval as shown, or any other desired cross section, such as square or other parallelogram etc, and it may or may not match a groove in which it is disposed. In an embodiment with a first groove 24 a first portion 54 of the fugitive material may have a shape that enables it to match a shape of the first groove 24, and thereby fit snugly there in, where it is held in place during a subsequent bi-casting of the shroud 14. The second groove fugitive material 50 may be larger than the first groove 24 such that it extends past a surface 52 of the airfoil 12. A second portion 56 of the second groove fugitive material 50 extends beyond the airfoil surface 52, and will form the second groove 26 in the shroud 14 during the subsequent bi-casting operation. The channel 22 formed may have a channel cross section that is the same as the cross section of the second groove fugitive material 50. In an embodiment the second groove fugitive material 50 (or any fugitive material meant to form a groove for a seal) may not comprise solely fugitive material. For example, the second groove fugitive material 50 could permeate a seal such as a rope seal that will ultimately serve as seal 20. In such an embodiment the fugitive material would prevent molten shroud material from penetrating the rope seal during the subsequent bi-casting operation. In such an embodiment the fugitive material may then be removed using any method known to those in the art and/or in conjunction with the method disclosed below. Once the fugitive material is removed from the rope seal, seal 20 would be a rope seal and disposed in the resulting channel 22.

In order to form a monolithic shroud a mold 58 may be disposed about an end 60 of the airfoil 12. Molten shroud material 62 may be poured into the mold 58, and around the airfoil end 60 and the airfoil feature 34. The bi-cast process is controlled as is known to those in the art such that there is no mechanical bonding between the airfoil 12 and the shroud 14.

Once the molten shroud material 62 cools sufficiently, the second groove fugitive material 50 is removed. A first opening must be formed to enable the removal of the second groove fugitive material 50. FIG. 5 depicts the assembly 10 from the top, a dotted outline of the channel 22, and the first opening 70. The first opening 70 permits access to the second groove fugitive material 50 so that it can be removed using techniques known to those in the art. The first opening 70 may be formed through the shroud 14 and may be formed by traditional methods known to those in the art, such as drilling. Alternately, the first opening 70 may be formed in a manner like that of the channel 22, where a first opening fugitive material (not shown) is disposed in the mold 58 where the first opening 70 is to be formed. The first opening fugitive material could then be removed using techniques known to those in the art such as leaching etc. The first opening 70 may be disposed at any location, and in an embodiment it is disposed in an area of low stress, as determined through modeling or experience. The first opening 70 may intersect the channel first end 38, the channel second end 40, or neither.

Once the first opening 70 is formed, the second groove fugitive material 50 is removed through the first opening 70 using techniques known to those in the art. Once the second groove fugitive material 50 is removed what remains is the channel 22. If the channel 22 is formed without a first groove 24, then the second groove 26 and an associated part of the airfoil surface 52 define the channel 22. If the second groove 26 is associated with a first groove 24, then the first groove 24 and the second groove 26 together form the channel 22. Design choices may call for groove shapes other than semi-circular, or a different shape for the first groove 24 than for the second groove 26 etc. Any configuration is acceptable so long as a channel 22 exists between the airfoil 12 and the shroud 14 such that a seal 20 can be disposed therein to stop leakage into the hot gas path.

Channel 22 may then be filled with a material that will form the seal 20. The material will be selected so that it is ductile when the turbine engine is at operating temperature, and yet retains sufficient cohesiveness to withstand a pressure difference across it. The material may be introduced in any number of acceptable ways. For example, the material may be molten and poured into the channel 22 via the first opening 70 where it solidifies into the seal 20. Alternately, the material may be in powder form and introduced by itself or in a suspension into the channel 22 where it eventually forms the seal 20. In an alternate embodiment the seal 20 may be a rope seal with fugitive material impregnated into the seal 20. In this embodiment the shroud 14 is poured as usual, and the groove fugitive material removed from the rope seal in a manner similar to removing the groove fugitive material in other embodiments, which leaves the rope seal in the channel 22.

When molten metal material is used, prior to its introduction into the channel 22 the assembly 10 may be heated to the melting temperature of the material. This step harmonizes the size of the channel 22 with the material such that when the molten material cools and shrinks, so does the channel 22 in which it is disposed. This minimizes or eliminates any gaps that might otherwise form in the channel 22 if the molten material were introduced into a relative cold channel that would not shrink as the molten material did.

In order to ease the introduction of the material and removal of any trapped air a second opening 72 may be formed through the shroud 14. In an embodiment, the first opening 70 may intersect the channel first end 38, and the second opening 72 may intersect the channel second end 40. In this embodiment the material may be introduced through the channel first end 38 as shown by arrow 74, and matter displaced by the material may exit the channel through the second opening 72 as shown by arrow 76. At the completion of this process the first opening 70, the channel 22, and the second opening 72 would be filled with material. Alternately, the molten material could be limited to the channel 22, and the first opening 70 and the second opening 72 could be closed through traditional welding.

The innovative seal and associated method of manufacture disclosed herein eliminates unwanted leakage in a vane assembly configuration where leakage has otherwise been unavoidable. The seal and method use existing techniques and knowledge in a different way and as a result, are inexpensive and easily implemented. Elimination of unwanted leakage will immediately improve engine performance. Advanced uses of a bi-cast vane assemblies may now also be explored that may in turn yield respective engine performance increases. Furthermore, close tolerances and associated expensive manufacturing practices that were pursued to reduce leakage may now be dispensed with in favor of leak reduction using the relatively inexpensive seal and method disclosed herein, providing a manufacturing cost savings. Consequently, the seal and method of manufacturing the seal disclosed herein represent an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A vane assembly comprising:

an airfoil and a shroud held together without metallurgical bonding there between;

a channel disposed circumferentially about the airfoil, between the airfoil and the shroud;

a seal disposed in the channel, wherein during operation of a turbine engine comprising the vane assembly the seal comprises a sufficient ductility such that a force generated on the seal resulting from relative movement of the airfoil and the shroud is sufficient to plastically deform the seal; and wherein the shroud is monolithic, the vane assembly further comprising interlocking features of the airfoil and the shroud that hold the airfoil and the shroud together.

2. The vane assembly of claim 1, wherein the airfoil and the shroud comprise sufficient structural integrity to operate without the seal.

3. The vane assembly of claim 1, wherein the relative movement causes seal material to move from an area of decreased channel volume to an area of increased channel volume.

4. The vane assembly of claim 1, wherein the channel is formed in only one of the airfoil or the shroud.

5. The vane assembly of claim 1, wherein the channel comprises a groove in the airfoil and an associated groove in the shroud.

6. The vane assembly of claim 1, wherein the channel spans less than an entire perimeter of the airfoil.

7. The vane assembly of claim 6, wherein an ungrooved area of the airfoil between ends of the channel is disposed on a suction side of the airfoil.

8. The vane assembly of claim 1, wherein the seal comprises a seal material comprising a Young's modulus of no more than approximately 220 GPa (20 million psi) at 800° C.

9. The vane assembly of claim 1, wherein the seal comprises a seal material comprising a creep rate of no less than 0.001 s−1 at a temperature of 800° C. with an applied stress of 500 MPa.

10. The vane assembly of claim 1, wherein the seal comprises a seal material comprising a melting temperature not greater than twice an operating temperature of the seal.

11. The vane assembly of claim 10, wherein the seal operating temperature is 500° C.±100° C.

12. The vane assembly of claim 1, wherein the seal comprises aluminum, aluminum alloys, tin, tin alloys, pure nickel, bronze, or brass.

* * * * *